US010016806B2

(12) United States Patent
Schaefer et al.

(10) Patent No.: US 10,016,806 B2
(45) Date of Patent: Jul. 10, 2018

(54) CASTING FLOW RUNNER SYSTEM AND A FRAME PROVIDED THEREFOR WITH A PREDETERMINED BREAKING POINT FOR METAL RESIDUE REMAINING IN PIPE SECTIONS

(71) Applicant: GTP SCHAEFER GIESSTECHNISCHE PRODUKTE GmbH, Grevenbroich (DE)

(72) Inventors: Joerg Schaefer, Cologne (DE); Thomas Schaefer, Frechen (DE)

(73) Assignee: GTP SCHAEFER GIESSTECHNISCHE PRODUKTE GmbH, Grevenbroich (DE)

( * ) Notice: Subject to any disclaimer, the term of this patent is extended or adjusted under 35 U.S.C. 154(b) by 0 days.

(21) Appl. No.: 15/261,704

(22) Filed: Sep. 9, 2016

(65) Prior Publication Data

US 2017/0080482 A1 Mar. 23, 2017

(30) Foreign Application Priority Data

Sep. 10, 2015 (DE) ..... 20 2015 104 814 U

(51) Int. Cl.

| | |
|---|---|
| ***B22C 9/08*** | (2006.01) |
| ***B22D 35/04*** | (2006.01) |
| ***B22D 31/00*** | (2006.01) |
| ***B22D 39/00*** | (2006.01) |

(52) U.S. Cl.

CPC ..... *B22C 9/08* (2013.01); *B22C 9/082* (2013.01); *B22D 31/002* (2013.01); *B22D 35/04* (2013.01); *B22D 39/00* (2013.01)

(58) Field of Classification Search

CPC ..... B22D 35/04; B22D 39/00; B22D 31/002; B22C 9/08; B22C 9/082

See application file for complete search history.

(56) References Cited

FOREIGN PATENT DOCUMENTS

| | | | | |
|---|---|---|---|---|
| DE | 3244079 A1 * | 6/1984 | ..... | B22C 9/086 |
| DE | 3836010 A1 * | 4/1990 | ..... | B22C 9/046 |

OTHER PUBLICATIONS

Hitchings et al. "Use Fabric, Breaker Cores to Cut Ductile Iron Finishing Cost". Reprinted from Feb. 1999 Modern Casting. http://www.comanchetechnologies.com/Documents/De-Gating%20Tech%20Paper%20to%20Revisit.pdf.*

English Machine Translation of DE 3244079.*

* cited by examiner

*Primary Examiner* — Kevin P Kerns
*Assistant Examiner* — Steven S Ha
(74) *Attorney, Agent, or Firm* — Johnson, Marcou & Isaacs, LLC; Jennifer S. Stachniak

(57) ABSTRACT

A casting flow running system (11) for supplying liquid metal to a mold cavity formed in a casting mold includes a plurality of pipe sections (13) that are connected to one another; at least one ingate pipe (13) for connecting the casting flow runner system (11) with an ingate of a casting model forming the mold cavity; and a frame (15) made of a heat-resistant material disposed on the ingate pipe (13). The frame has a net-like webbing (18) made of a fireproof material tensioned therein and is attached to the ingate pipe (13) such that the netlike webbing (18) at least partially spans a cross section of the ingate pipe (13) and is positioned in a region proximate to a surface of a casting piece formed by filling the mold cavity.

18 Claims, 4 Drawing Sheets

CASTING FLOW RUNNER SYSTEM AND A FRAME PROVIDED THEREFOR WITH A PREDETERMINED BREAKING POINT FOR METAL RESIDUE REMAINING IN PIPE SECTIONS

CROSS-REFERENCE TO RELATED APPLICATIONS

The instant application claims the priority date of Sep. 10, 2015, the filing date of the German patent application DE 20 2015 104 814.9.

BACKGROUND OF THE INVENTION

The invention relates to a casting flow running system for supplying liquid metal to mold cavities formed in a casting mold, whereby the casting flow runner system comprises respectively joined pipe sections and respectively, at least one ingate pipe is provided for connecting the casting flow runner system with an ingate of the casting model forming the mold cavity, as well as a frame provided for this type of casting flow runner system having a predetermined breaking point for the metallic residue remaining in the pipe system.

In casting technology, so-called casting flow runner systems are used, as described, by way of example, in DE 38 26 010 A1. For supplying the hot, liquid metal melt to a mold cavity formed in a casting mold by means of a casting model formed therein, a casting flow runner system formed by pipe sections that are connected together is installed and commonly molded with the casting model in the casting mold, by means of which the metal filling one or more infeeds are conducted to a component of the ingates forming the mold cavity, that is, molding plugs, and is divided accordingly. The last pipe sections leading to the ingates to the mold cavity are therefore designated as ingate pipes.

With this type of casting flow runner system, generally a problem exists in that after casting in the area of the ingate, respectively, hardened casting material remains in the interior, in particular, of the ingate pipe, which must be removed after the casting piece is removed from the mold. This causes substantial separation and cleaning expense, depending on the respective cross section of the ingate pipe. In the same manner, the removal of the casting piece is made more difficult because of the metallic residue remaining in the pipe sections of the casting flow runner system.

In addition, it is known from DE 29 05 682 C2, for example, to anchor a casting filter in an open casting system with a casting gate or down sprue formed in the mold sand of the casting mold; the casting filer sufficiently filters out foreign bodies in the liquid metal, on the one hand, and on the other hand, separates the stream of the liquid metal cast into the casting gate or down sprue into individual streams, and in this manner, should reduce the existing casting pressure. This technique cannot be used, however, with a casting flow runner system formed from pipes.

SUMMARY OF THE INVENTION

The present invention is therefore based on the object of addressing the problems associated with a casting flow runner system with the above-described features, in particular, to maintain to as little as possible the costs for separating and cleaning metallic residue associated with the ingate pipes on the produced casting piece. It is also an object to facilitate removal of the casting piece.

The invention contemplates that a frame made of a heat-resistance material is positioned and secured to the ingate pipe. A netlike webbing made from a fireproof material spans the frame and is tensioned therein. The frame is positioned and secured to the ingate pipe such that the netlike webbing at least partly crosses the cross section of the ingate pipe and is positioned directly near the surface of the casting piece to be formed by filling of the mold cavity.

The netlike webbing mounted in the cross section of the ingate pipe forms a metallic layer interfused and crossed by the webbing, based on the bathing of the net structure by the hot metal after setting, so that a defined metal weakening is formed and a chipping or knocking off of the hardened metallic residue inn the ingate pipe exactly in the flow of the webbing layer occurs. Since simultaneously, the netlike webbing is positioned in the cross section of the ingate pipe so that the netlike webbing is located during the casting process in the direct vicinity of the surface of the casting piece, breaking off or separation of the metallic residue takes place directly on the casting piece surface, so that the necessary cleaning expense is reduced accordingly. In that the present invention further proposes a frame fixed to the ingate pipe for holding the netlike webbing, the advantage is provided that the frame with the netlike webbing is relatively easy to produce and to mount to the ingate pipe. In that a sufficient tensioning of the netlike webbing in the flow path between the mold cavity and the ingate pipe must be ensured, so that the webbing is not pushed into the mold cavity and therewith, into the casting piece structure during the flow-through of the liquid metal during casting, the arrangement of the frame makes possible a corresponding tensioning and holding of the netlike webbing on the frame. The use of a frame comprising a heat-resistance material for holding the tensioned netlike webbing offers the additional advantage that the frame is not melted by the hot metal flowing through the casting flow runner system and thus, combustion gases that could be detrimental to the casting process do not exist.

According to a first embodiment of the invention, for a directly attachment of the frame, it is provided that the frame is made in the form of a displacement sleeve and has a pipe section that engages over the end of the ingate pipe, with which the frame is attachable onto the end of the ingate pipe. Thus, it is especially advantageous if the frame is made from a fireproof material, in particular ceramic. Since the ingate pipe is attached in a suitable manner after molding of the casting model with the casting flow runner system by means of mold sand in the casting mold, the frame is simultaneously also attach dot the ingate pipe; if necessary, a press fit or force fit can be provided via the diametric ratios of the ingate pipe and the frame.

According to another embodiment of the invention, it is provided that the frame has radially projection that extends from the outer circumference of its pipe section. This projection serves on the one hand as an aid in operation and manipulation during mounting of the frame to the ingate pipe and on the other hand, with the casting flow system including the casting model formed in the casting mold, for attachment of the frame in the mold sand that is introduced, since undercuts are formed in the sand because of the projection, which prevent movement of the ingate pipe with the frame attached thereto. The corresponding projection can be formed completely circumferential, or one or more projections can be provided that extend over a partial area of the circumference of the ingate pipe.

It can be provided that the frame comprises two frame parts, preferably made from metal, which are moveable relative to one another, and which are attachable to one another after the necessary tensioning of the netlike webbing is applied, whereby the frame parts can be connected to one another, for example at individual points by spot welding. In this regard, the frame parts can be insertable into one another and the netlike webbing received therebetween and tensioned by insertion of the frame parts into one another. Other forms of connections, such as adhesive or the like, are also possible.

Alternatively, it can be provided that a first inner frame part has a cylindrical shape with an inner flange formed on one of its ends and a second outer frame part has a cylindrical shape that outwardly encompasses the first frame part with the outer lying projection on the one hand and an inner flange, on the other hand, associated with the inner flange of the first frame part, whereby upon insertion of the frame parts, the flanges of the two frame parts receive and tension the netlike webbing therebetween.

As a particular connecting technology for the frame parts for forming of the frame that tensions the netlike webbing, according to one embodiment, clinching according to the so-called TOX® method is proposed. Accordingly, it is provided that the frame parts are connected to one another, with the netlike webbing placed therebetween, via positive-fit and push or snap button connections produced as a result of a cold working process, whereby the punctiform connections of the frame parts, respectively, catch the netlike webbing placed between the frame parts. So that the netlike webbing placed between the frame parts before clinching is fixed by the so-called TOX® points, an improved and more stable clamping of the netlike webbing occurs in the frame in which the webbing is held, also with corresponding demands created by the metal flowing through the netlike webbing. In addition, by means of the various positions on the circumferential of the frame of the TOX® points, the tensioning of the netlike webbing in the frame is improved, and finally, the corresponding connecting technology is simple and cost-effective in serial production of the frame, because no heat treatment or application of additional connecting elements is required.

The object is also solved by a casting flow runner system, in which a frame with a netlike webbing tensioned therein is arranged between individual pipe sections of the casting flow runner system, whereby the frame positioned between individual pipe sections can be provided in addition to a frame arranged on an ingate pipe. It is not necessary, however, that frames also must be mounted on the associated ingate pipes with the arrangement of the frame between individual pipe sections of the casting flow runner system. For improvement of the removal of the casting piece after completion of the casting process, it is sufficient if frames are arranged only between individual pipe sections of the casting flow runner system with the netlike webbings tensioned therein, because in this manner, in development of the metallic residue formed in the pipe sections of the casting flow runner system, further predetermined breaking points are produced. Upon removal or demolding, the formation of corresponding predetermined breaking points between the pipe sections allows the metallic residue in the pipe sections forming the casting flow runner system to be removed in separate parts.

According to one embodiment of the invention, it is provided that the frame has a greater dimension that the ingate pipe or the pipe section of the casting flow runner system and is arranged on the outside of the ingate pipe or the pipe section, and that the netlike webbing extends over the entire cross section of the ingate pipe or the pipe section In this manner, it is ensured that the liquid metal flows only through the netlike webbing and that the frame is not contacted directly by the liquid metal. Thus, no particular thermal stress of the frame occurs, in particular insofar as the frame is made from metal.

For improving the shielding of the frame holding the netlike webbing from the effects of heat from the liquid metal, it can be provided that the frame is held in a special adapter, preferably comprising a fireproof material, such as a ceramic so that the frame is attached in an indirect manner in the casting mold.

In this connection, it can be provided that the adapter comprises two adapter parts that are engageable in one another in a form-locking manner so that the frame is clamped between the two adapter parts, such that the netlike webbing tensioned in the frame extends over a flow-through opening formed in the adapter parts.

It can therefore be provided that the frame parts that are insertable into one another each have a cub-shaped design with a tapered contour that extends slightly conically from an upper end of a side wall of the frame parts to its lower end with the netlike webbing attached thereto and on the upper end of the side wall, a flange projecting therefrom is arranged with the TOX®-points arranged therein.

Regarding arrangement of a frame with a netlike webbing on the ingate pipe, it can be provided that upon connection of the adapter to the ingate pipe, one adapter part has a recess on an outer side of the adapter for insertion into an end of the ingate pipe and the other adapter part has a disk-like design, such that the netlike webbing extends on an outer face of the adapter part in the region of a contact plane of the adapter on the mold cavity of the casting mold. This enables the netlike webbing to be position in the direct area of the surface of the casting piece to be formed by filling of the mold cavity.

With regard to arrangement of the frame with the netlike webbing between individual pipe sections of the casting flow runner system, it can be provided that with arrangement of the adapter between pipe sections of the casting flow runner system, one adapter part has a recess on an outer side of the adapter for insertion of the adapter part into an end of a pipe section of the casting flow runner system, and the other adapter part on the opposite outer side of the adapter has a receiving element for insertion of the end of a further pipe section into the adapter part.

With regard to the netlike webbing, according to the present invention, the netlike webbing can be embodied as a metallic wire webbing or also as a net made from a fireproof webbing or webbing fibers or threads.

In addition, to avoid too great of a flow resistance, it can be provided that the netlike webbing has a through ole for reducing the flow resistance, which has a smaller dimension that the free cross section of the ingate pipe. In this connection, according to the present invention, it can be provided that the through hold has a surface of 5 to 90% of the free cross sectional surface of the ingate pipe, whereby the net width, that is the width of the net openings, is 1 to 20 mm with a width of the fibers forming the net structure being 1 mm to 15 mm.

BRIEF DESCRIPTION OF THE DRAWINGS

In the drawings, exemplary embodiments of the invention are shown, which will be described below in greater detail. In the drawings.

DETAILED DESCRIPTION OF THE PREFERRED EMBODIMENTS

Figure 1:
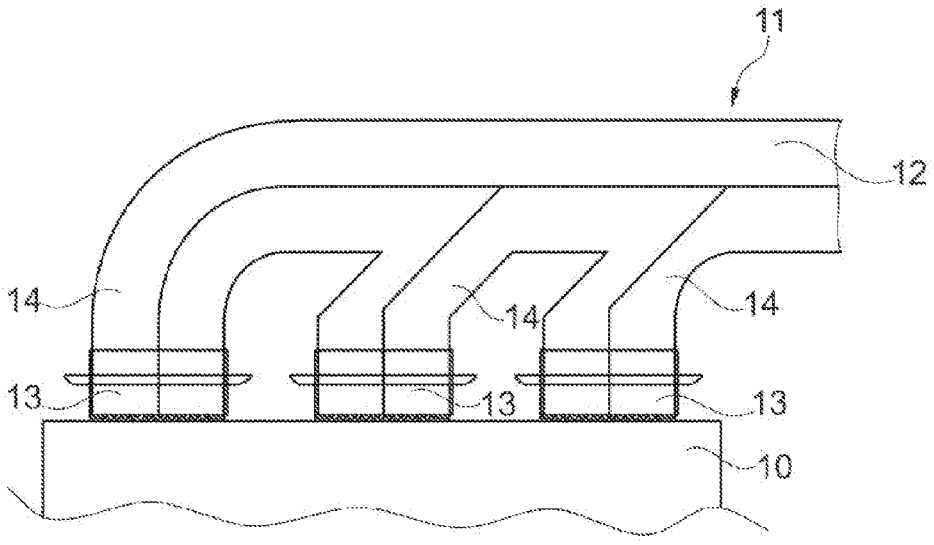
FIG. 1 shows a mold cavity in a casting model forming a casting mold with a casting flow runner system connected thereto in a schematic representation.

FIG. 1 shows in a schematic representation a casting model 10 on which a casting flow runner system is disposed, which is formed together with the casting model during production of a casting mold in the mold sand. The casting model comprises a central supply pipe 12 with, respectively, an advantageous design, whereby the casting flow runner system 11 has at least one or multiple inlets 14 for filling the subsequent mold cavity with liquid metal as wells as individual pipe sections 13 in the area of the transition from the casting flow runner system 11 to the casting model 10, via which the liquid metal conducted into the casting flow runner system 11 enters into the cavity mold formed by the casting model 10.

Figure 2:
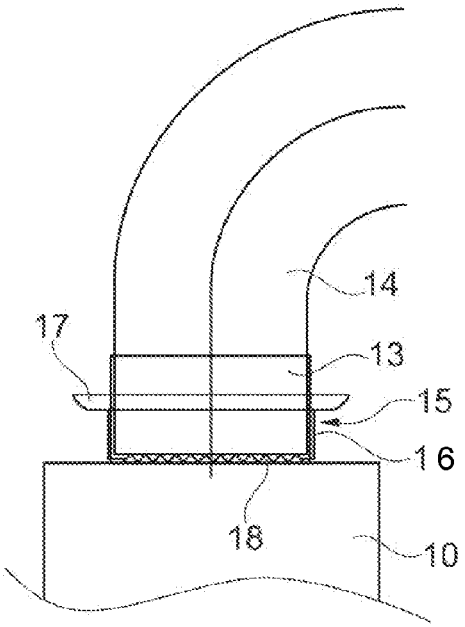
FIG. 2 shows the connection of an angled pipe section to the casting model in an enlarged representation that includes a frame.

As provided in FIG. 2, a frame 15 is disposed between the end of one pipe section 13 and the casting model 10; the frame 15 supports and tensions within it a netlike webbing (FIG. 3) which crosses the cross section of the pipe section 13. The pipe-like frame 15 formed with a corresponding diameter is displaced with a ingate pipe 16 onto the associated pipe section 13. On the outer circumference of the ingate pipe 16, a radially outwardly projecting projection 17 is disposed, which, on the one hand, can assist with assembly of the casting flow runner system 11 for mounting of the frame 15 and on the other hand, also is surrounded by the mold sand that is introduced into the casting flow runner system including the casting model formed in the casting mold and based on the formed undercuts, is fixed into its position to the ingate pipe and mold cavity.

Figure 3:
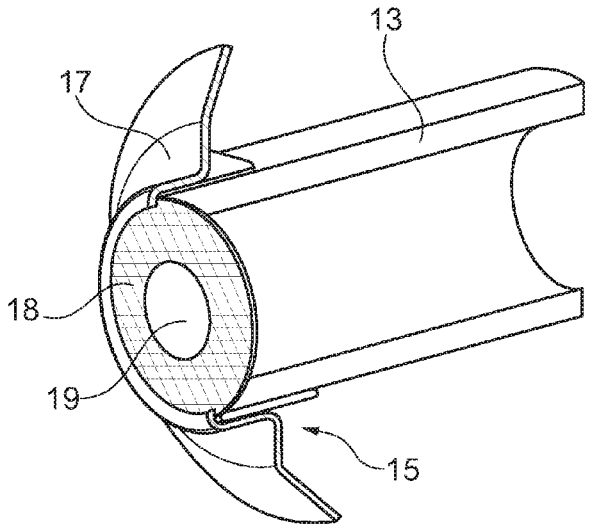
FIG. 3 shows the pipe section with the frame that holds a netlike webbing inserted thereon in a detail representation.

As can be seen from FIG. 3, a netlike webbing 18 is secured to the end of the pipe-shaped frame 15 facing the casting model 10, the netlike webbing crossing over the cross section of the ingate pipe 13. With the embodiment shown, a through-hole 19 is provided in the netlike webbing for reducing the flow resistance, the through-hole 19 having a smaller dimension than the cross section of the ingate pipe, so that as a result, the netlike webbing crosses over at least partially the cross section of the ingate pipe. Specifically, according to an embodiment of the invention, it can be provide that the through hole 19 has a surface of 5 to 90% of the free cross sectional surface of the frame enclosed by the frame, whereby the net width, that is, the width of the net opening, is 1 mm to 20 mm with a width of the fibers forming the net structure being 1 mm to 15 mm. The netlike webbing 18 further is arranged on the frame 15 such that the netlike webbing is poisoned in the directly area of the surface of the casting piece formed by filling the mold cavity forming the casting model 10, so that the metallic residue remaining in the frame including the ingate pipe can be knocked off near the casting piece surface. The netting also can be made from wire mesh or from a fireproof webbing.

Figure 4:
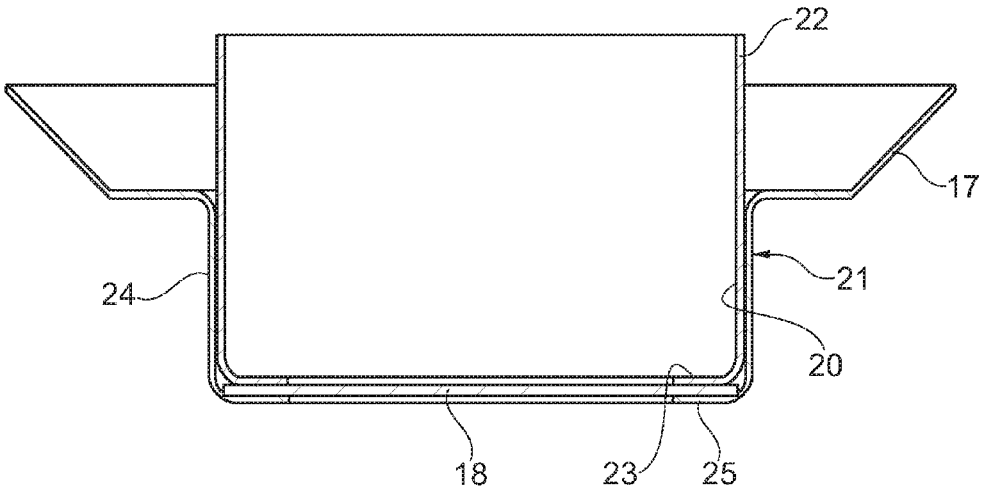
FIG. 4 shows the frame of FIG. 2 or 3 in an enlarged sectional representation.

With the embodiment that is shown, which is shown in greater detail in FIG. 4, the frame 15 is formed by two frame parts that can be inserted into one another, namely, a first inner frame part 20 and a second outer frame part 21. The first inner frame part 20 has a cylindrical design 22 and has an inwardly resilient flange 23 on one of its ends. With its cylindrical section 22, the frame part 20 is displaceable onto the end of the ingate pipe 13 and thereby forms the corresponding pipe section 16 (FIG. 2). Also, the second outer frame part 1 received the first inner frame part 20 upon insertion into one another has a cylindrical design 24 that outwardly encompasses the first frame part 20 with the outward projection 17 formed on this cylindrical section and has an inner flange 25 associated with the inner flange 23 of the first frame part 20. Upon insertion of the frame parts 20 and 21 into one another, the flanges 23, 25 of the two frame parts 20, 21 are oriented parallel to one another and receive and tension the netlike webbing 18 therebetween.

Figure 5:
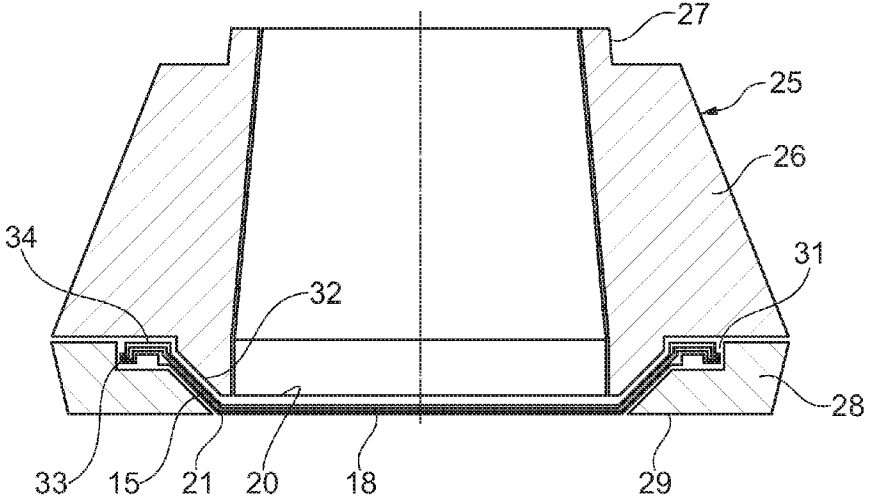
FIG. 5 shows an adapter for connection to a connecting pipe with a frame secured thereto in a sectional representation.

The embodiment shown in FIG. 5 shows an adapter comprising a ceramic, selected from a group of fireproof materials, in which the frame tensioning the netlike web 18 is held, whereby the adapter 25 itself is molded during the making of the casting mold in the mold sand and in this manner, is secured in the casting mold. In this regard, the frame 15 is attached indirectly relative to the mold cavity or later casting piece. The adapter 25 is formed, such that it forms the transition of the ingate pipe 13 to the later mold cavity or to the casting piece after termination of the casting process.

The adapter 25 comprise a first adapter part 26, which has a return 27 for on one of its ends for insertion into or connection to the ingate pipe 13. A second, annular adapter part 28 cooperates with the first adapter part 26 via a form-locking design 31, so that when the adapter parts 26 and 28 are connected, the provided adapter 25 is formed. The adapter part 28 faces the mold cavity with its lower contact plane 29 during casting in the casting mold. Between the adapter parts 26 and 28, the frame 15 is positioned with the netlike webbing 18 tensioned therein, whereby the frame 15 has a design equipped with a form-locking design 31 between the adapter parts 26, 28, so that the frame 15 is fixed between the two adapter parts 26, 28.

Figure 6:
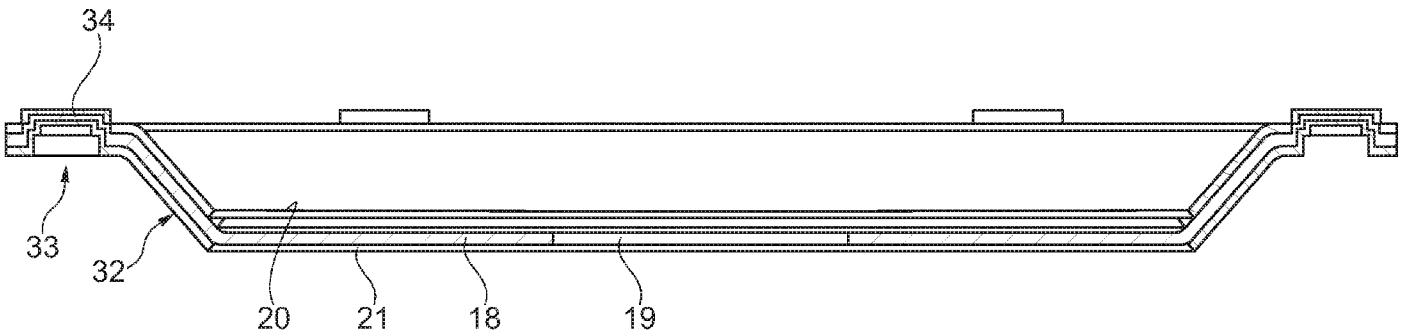
FIG. 6 shows a frame made by using clinching as a connection technique for the frame parts in a partial view.

As FIG. 6 shows, the frame 15 in turn comprises two frame parts 20, 21, which are insertable into one another, each of which has a cup-shaped design with a tapered contour that extends slightly conically from the upper end of a respective side wall 32 to its lower end with the netlike webbing 18 attached thereto. A respective radially projecting flange 33 is located on the upper end of the sidewall in both frame parts 20, 21. This special design of the frame parts 20 or the assembled frame 15 makes possible a secure attachment between the adapter parts 26, 28. Based on the cup-shaped design, it is further possible that the netlike webbing 18 spans a through-opening 30 formed in the adapter 25 or it part 26, 28 on the corresponding face of the adapter part 28 in its contact plane 29, so that the netlike webbing 18 lies directly against the mold cavity.

FIG. 6 shows further technically advantageous connecting techniques which are simple to use for serial production and in consideration of the specifications of the frame 15 including the netlike webbing 18 tensioned within the frame. The connection techniques are suitable for connecting the two U-shaped frame parts 20, 21, whereby preferably the U-leg 31 of the U-shaped frame 15 is shown as only one U-leg. It is to be recognized that a netlike webbing 18 having a through hole 19 is positioned between the frame parts 20, 21 and also extends in the region of the side walls 32 resting on one another, as well as the subsequent flanges 33 of the two frame parts 20, 21. In this region, the two frame parts 20, 21 are connected to one another in a clinching process by application of so-called TOX® points 23. With this know connection technique, additional connection means are not needed and no heat is used for form-locking and punctiform connections made in a cold-forming process in the region of the flange 33, whereby the TOX® points 34 are produced by applying a matrix stamped in a die with impression of the material layer lying between the matrix stamped and the die into the die. Based on the specialized form of the die, a corresponding material strength in the die area is provided, so that quasi push button type connections are formed. By means of the punctiform impression of the two flanges 33 including the netlike webbing 18 lying therebetween in the die used in the clinching process, the net tensioning is increased and is fixed accordingly after completion of the cold forming process.

As discussed, it is sufficient for an improvement of the demolding process after termination of casting when frames are used only between individual pipe sections 12 of the casting flow runner system 11 with webbings 18 tensioned in the frames 15.

Figure 7:
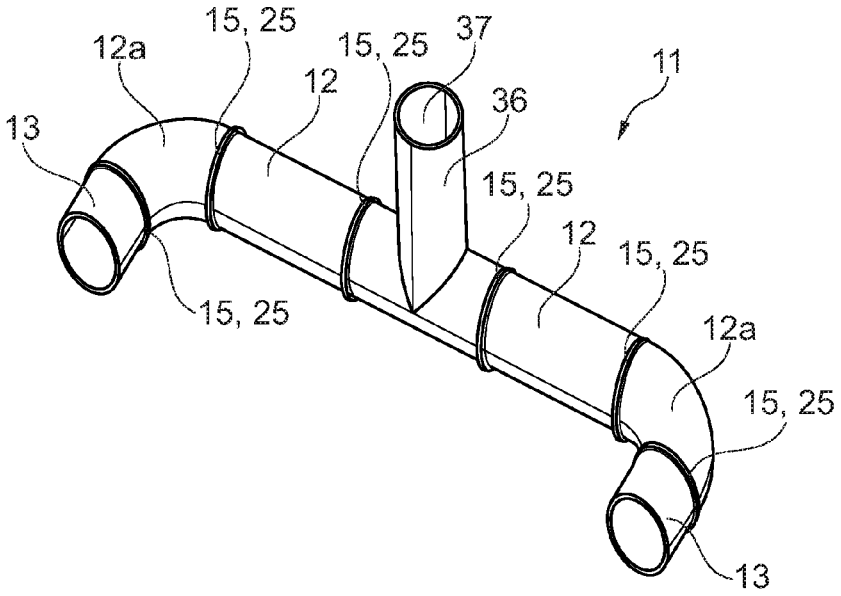
FIG. 7 shows a casting flow runner system with individual tube sections in a schematic representation.

Such a casting flow runner system 11 is shown schematically in FIG. 7. It comprises in the shown, simplified embodiment an inlet pipe 36 with an upper inlet opening 37. On the foot of the T-shaped inlet pipe 36, a pipe section 12 is connected, which is connected via an elbow or bend 12*a* with an ingate pipe 13 and on the other hand, with a pipe neck of the inlet pipe 36. A frame 15, and if necessary, with an adapter 25 is connected to the ends of each pipe section 12 or elbow 12*a*, respectively, in the connection to the ingate pipe 13 on the one hand and to the inlet pipe 36 on the other hand, which form a an effective predestined breaking point upon demolding.

Figure 8:
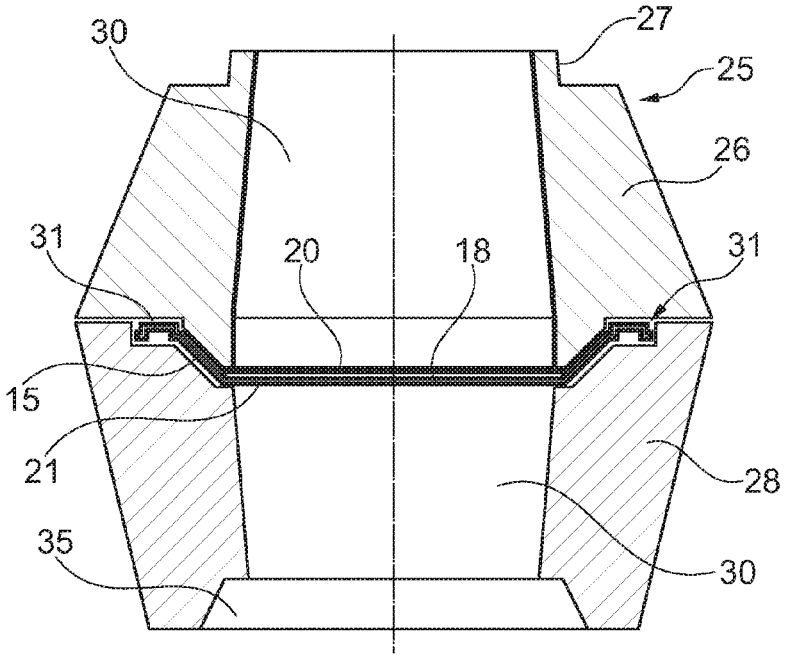
FIG. 8 shows an adapter for placement between individual pipe sections of a casting flow runner system in a sectional representation.

The two-part adapter is shown in FIG. 8. The adapter is provided between a pipe section 12 and a further pipe section attached thereto, such as an inlet pipe 36 or ingate pipe 13. The adapter part 26 is formed as described above with reference to FIG. 5. The other adapter part 28 has on its outer end a recess 35, in which a further pipe section can be inserted. The formation and fixing of the frame 15 made from the two frame parts 20, 21 corresponds to the embodiment shown and described with reference to FIGS. 5 and 6.

The features of the subject matter of this invention set forth in the above description, the patent claims, the abstract and the drawings can be used individually and in any desired combination for the realization of the invention in its various embodiments.

The specification incorporates by reference the disclosure of DE 20 2015 104 814.9, filed Sep. 10, 2015.

The present invention is, of course, in no way restricted to the specific disclosure of the specification and drawings, but also encompasses any modifications within the scope of the appended claims.

We claim:

1. A casting flow running system (11) for supplying liquid metal to a mold cavity formed in a casting mold, comprising:

a plurality of pipe sections (12) that are connected to one another;

at least one ingate pipe (13) for connecting the casting flow runner system (11) with an ingate of a casting model (10) forming the mold cavity;

a frame (15) comprising a heat-resistant material disposed on the at least one ingate pipe (13), said frame having a netted webbing (18) made of a fire-proof material tensioned therein, wherein the frame (15) is attached to the at least one ingate pipe (13) at an open end of the at least one ingate pipe, such that the netted webbing (18) at least partially spans a cross section of the open end of the at least one ingate pipe (13) and is positioned in a region proximate to a surface of a casting piece formed by filling the mold cavity.

2. The casting flow running system (11) according to claim 1, wherein the frame (15) is in the form of a displacement sleeve and has a pipe section (16) outwardly engaging over the end of the at least one ingate pipe (13), wherein the frame (15) is attachable onto the end of the at least one ingate pipe (13) via the pipe section (16).

3. The casting flow running system (11) according to claim 2, wherein the frame (15) has a projection (17) that radially projects from an outer circumference of the pipe section (16).

4. The casting flow running system (11) according to claim 1, wherein the frame (15) comprises two frame parts (20, 21) that are movable against one another, wherein said frame parts are securable to one another after application of required tensioning of the netted webbing (18).

5. The casting flow running system (11) according to claim 4, wherein the frame parts (20, 21) are insertable into one another, wherein the webbing (18) is tensioned between the frame parts (20, 21) by insertion of the frame parts into one another.

6. The casting flow running system according to claim 4, wherein the frame parts (20, 21) comprise a first inner frame part (20) and a second outer frame part (21), said first inner frame part (20) having a cylindrical shape (22) and a first inner flange (23) disposed on an end of said first inner frame part (20), said second outer frame part (21) having a cylindrical shape (24) outwardly surrounding the first inner frame part (20), said second outer frame part (21) having an outward projection (17) and a second inner flange (25) associated with the first inner flange (23) of the first frame part (20), wherein when said frame parts (20, 21) are inserted into one another, the first inner flange (23) and the second inner flange (25) of the respective frame parts (20, 21) receive and tension the netted webbing (18) therebetween.

7. The casting flow running system (11) according to claim 4, wherein the frame parts (20, 21) with the netted webbing (18) positioned therebetween are connected to one another via clinching by form-locking and push button connectors made in a cold forming process, wherein the connectors of the frame parts (20, 21) are spaced apart from one another and catch the netted webbing (18) secured between the frame parts (20, 21).

8. The casting flow running system (11) according to claim 4, wherein the frame (15) is dimensioned to be larger than the at least one ingate pipe (13) or a pipe section (12) of the casting running flow system (11) and is disposed outside of the at least one ingate pipe (13) or the pipe section (12), respectively, wherein the netted webbing (18) extends over an entire cross section of the at least one ingate pipe (13) or the pipe section (12), respectively.

9. The casting flow running system (11) according to claim 4, wherein the frame (15) is held in a separate adapter (25) made from a fireproof material.

10. The casting flow running system (11) according to claim 9, wherein the adapter (25) comprises two form-locking adapter parts (26, 28) that engage in one another and thereby clamp the frame (15) therebetween, such that the netted webbing tensioned within the frame (15) extends over a through-flow opening (30) formed in the adapter parts (26, 28).

11. The casting flow running system (11) according to claim 10, wherein upon connection of the adapter (25) to a pipe section (13), one of said adapter parts (26) has a return (27) on an outer side of the adapter (25) for insertion into an end of the pipe section (13), and the other of said adapter parts (28) has a disk-shaped form, such that the netted ebbing (18) extends on the mold cavity of the casting mold on an outer face of the adapter part (25) in an area of a contact plane (29) of the adapter (25).

12. The casting flow running system (a1) according to claim 10, wherein upon arrangement of the adapter (25) between the pipe sections (12) of the casting flow running system (11), one of said adapter parts (26) has a return (27) for insertion of the adapter part (26) in an end of the pipe section (12) of the casting flow running system (1) on an outer side of the adapter (25) and the other of said adapter parts (28) has a receiving element (35) on an opposite outer side of the adapter (25) for insertion of the end of a further tube section (12) into the adapter part (28).

13. The casting flow running system (11) according to claim 4, wherein the fireproof material is ceramic.

14. The casting flow running system (11) according to claim 13, wherein the frame parts (20, 21) that are insertable into one another have, respectively, a cup-like form with an approximately conical contour that tapers from an upper end to a side wall (32) of the frame parts (20, 21) to a lower end with the netted webbing (18) secured therein, wherein a flange (30) is positioned on and projecting from on an upper end of the side wall (32), and wherein clinching points (34) are arranged on said flange (30).

15. The casting flow running system (11) according to claim 1, wherein a frame (15) with a netted webbing (18) tensioned within the frame (15) is disposed between individual pipe sections (12) of the casting flow running system (11).

16. The casting flow running system (11) according to claim 1, wherein the netted webbing (18) has a through-hole (19), which has a smaller size than the free cross section of the at least one ingate pipe (13).

17. The casting flow running system (11) according to claim 16, wherein the through-hole (19) has a surface of 5% to 90% of a free cross sectional surface of the at least one ingate pipe (13).

18. The casting flow running system (11) according to claim 1, wherein a width of a net opening in the netted webbing (18) is 1 mm to 20 mm, and wherein a width of fibers forming the netlike webbing (18) is 1 mm to 15 mm.

* * * * *